US008893350B2

(12) United States Patent
Mai

(10) Patent No.: US 8,893,350 B2
(45) Date of Patent: Nov. 25, 2014

(54) WATER HEATER TANK CLEANING APPARATUS AND KIT, AND METHOD OF USE THEREOF

(76) Inventor: Hoa Mai, Enterprise, AL (US)

( * ) Notice: Subject to any disclaimer, the term of this patent is extended or adjusted under 35 U.S.C. 154(b) by 779 days.

(21) Appl. No.: 13/114,560

(22) Filed: May 24, 2011

(65) Prior Publication Data

US 2012/0298143 A1 Nov. 29, 2012

(51) Int. Cl.

| | |
|---|---|
| ***A47L 9/02*** | (2006.01) |
| ***B08B 9/08*** | (2006.01) |
| ***B08B 5/04*** | (2006.01) |
| ***F24H 9/00*** | (2006.01) |
| ***F24D 19/00*** | (2006.01) |
| ***F28G 1/00*** | (2006.01) |
| ***F28G 13/00*** | (2006.01) |

(52) U.S. Cl.

CPC ... *B08B 9/08* (2013.01); *B08B 5/04* (2013.01); *F24H 9/0042* (2013.01); *F24D 19/0092* (2013.01); *F28G 1/00* (2013.01); *F28G 13/00* (2013.01)

USPC ..... 15/414; 15/300.1; 15/304; 15/395

(58) Field of Classification Search

USPC ..... 15/300.1, 304, 395, 414

See application file for complete search history.

(56) References Cited

U.S. PATENT DOCUMENTS

| | | | | |
|---|---|---|---|---|
| 2,203,088 | A * | 6/1940 | Hansson | 285/7 |
| 4,053,962 | A | 10/1977 | McDowell | |
| 4,976,004 | A | 12/1990 | Bufford-Thacker | |
| 5,054,160 | A | 10/1991 | Marino | |
| D368,996 | S | 4/1996 | Boyer | |
| 5,715,569 | A | 2/1998 | Dickey | |
| 6,189,559 | B1 | 2/2001 | Williams | |
| 7,887,104 | B1 | 2/2011 | Wilson | |
| 2002/0092103 | A1 * | 7/2002 | Bruno et al. | 15/1 |

* cited by examiner

*Primary Examiner* — Saeed T Chaudhry

(74) *Attorney, Agent, or Firm* — Mathew L. Grell; Balser & Grell IP Law

(57) ABSTRACT

A water tank cleaning apparatus and kit of components, the apparatus utilizing a wet or dry vacuum source, an adapter having one part of a two-component separable connector with a thumb tab thereon to facilitate separation of the two-component separable connector, and a working tip element having a second part of the two-component separable connector and functional end.

13 Claims, 4 Drawing Sheets

WATER HEATER TANK CLEANING APPARATUS AND KIT, AND METHOD OF USE THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to water heater cleaning apparatus, and more specifically to an apparatus comprising quick disconnect attachments and a kit combining same for cleaning out a water heater using a vacuum cleaner capable of handling liquids.

2. Description of Related Art

Water heaters, particularly those installed in residences and small buildings, require occasional cleaning to remove scale that builds up over time as salts dissolved in water precipitate inside the water heater tank body. In order to remove the scale, the water within the tank is first drained. This is typically accomplished via an openable drain outlet near the bottom of the tank. Often such a drain outlet is threaded with a male hose fitting to which a garden hose-type female fitting is secured, thereby permitting the garden hose to be extended outside the building to carry the water from the tank for outside disposal.

Once the water is drained from the water heater tank, scale can be removed. While some scale will be removed via the garden hose, more dense deposits will require entry of a removal apparatus into the water heater tank to extract the deposit. Such may readily be accomplished via a tube that is inserted through an aperture exposed by removal of the tank heating element. However, removal of water and scale in the above-referenced fashion requires a succession of instruments that are not typically part of the same apparatus and which separately may not be readily adaptable to use with a wet/dry vacuum cleaner.

One previous device is a manipulable cleaning tube adapted to be attached to a vacuum cleaner that is utilized through being inserted in the same tank aperture that contains the heater tank's heating element. However, this device must both remove water and scale and for the former is cumbersome, particularly because it must be hand-held in position during the entire time that the tank is being drained. Further, this device lacks the ability to quickly interchange various working tip elements.

Another device provides a stepped body structure, wherein each step is individually utilized to fit different sized tubes coming from different vacuum sources. However, this device also lacks the ability to allow quick interchange of a variety of working tip elements therewith.

Moreover, trying to utilize different implements is often difficult, even when they interconnect, as water that has been removed from the tank makes it difficult to separate the now-slippery working tip elements of the implements for interchange with other working tip elements.

Therefore, it is readily apparent that there is a need for a water tank cleaning apparatus that has readily interchangeable working tip elements that are adapted to remove water and scale from the water tank and which can be interchanged easily when they are wet.

BRIEF SUMMARY OF THE INVENTION

Briefly described, in a preferred embodiment, the present invention overcomes the above-mentioned disadvantages and meets the recognized need for such a device by providing water tank cleaning apparatus with kit of components, the apparatus utilizing a wet or dry vacuum source, adapters for connecting to the vacuum source, the adapters having one part of a two-component separable connector with a thumb tab thereon to facilitate separation of the two-component separable connector, and working tip elements with an opening, the working tip elements having a second part of the two-component separable connector.

According to its major aspects and broadly stated, the present invention in its preferred form is a water tank cleaning apparatus comprising a vacuum source, an adapter with its first end connected to the vacuum source and a second end that is a first component of a two-component separable quick disconnect connector. The vacuum source and the adapter are in fluid communication, and the first component is rotationally restricted and has a thumb tab thereon that extends radially from the first component. The thumb tab facilitates separation of the two-component separable connector when force applied to the thumb tab urges the first component towards the first end.

One adapter is straight, another has stepped reductions and the third adapter has a handle thereon. Each adapter receives a vacuum cleaner hose end in interference fit (in the case of the stepped reductions, different diameter hose ends) at the end away from its quick disconnect connector portion.

The cleaning apparatus also comprises a working tip element that has an opening in one end and a second component of the two-component separable quick disconnect connector at the other end. The first and second components cooperatively engage and permit fluid communication between the working tip element and the adapter. The first component comprises a spring that urges the first component away from the first end and the first component is slidably operational in a direction parallel to a longitudinal axis of the adapter. One working tip element comprises a cooperative connector, such as a female hose fitting, that is adapted to engage a water outlet fitting on the water tank. The other working tip comprises and extended bendable tube that retains its shape once it is bent.

Each adapter has a body section disposed between its first end and second end, while the handled adapter additionally comprises a vertical leg and a horizontal arm, wherein the vertical leg extends at approximately a ninety degree angle to the body section and the horizontal arm is parallel to and spaced away from the body section by the vertical leg. The handle provides a fixed anchor against which a back portion of an operator's hand rests when the hand grips the body section, thereby providing leverage to rotate the water tank cleaning apparatus via in cooperation between the thumb of the operator's hand which rests for leverage against the thumb tab.

The preferred embodiment comprises a kit of the wand, the hose and the three adapters, namely, the straight adapter, the step-down adapter and the handled adapter.

To utilize the preferred embodiment to clean a water tank, the components of the water tank cleaning apparatus are obtained, an adapter is connected to the vacuum source and the working tip element is connected to the adapter. Once assembled, water is drained conventionally from the water tank and remaining water and debris are removed from the water tank via the hose and the wand. Further steps include replacing one of the plurality of adapters with another of the adapters, and replacing one of the plurality of working tip elements with another of the plurality of working tip elements, When using the handled adapter, leverage to rotate the working tip element is provided via cooperation between an operator's thumb resting against the thumb tab and a back portion of an operator's hand resting against the horizontal arm of the handle. The leverage facilitates rotating the working tip element from side to side, wherein water and scale are removed from the water tank.

More specifically, the present invention is a water heater cleaning kit comprising a hose section, a wand, a straight adapter, a step down adapter and a handled adapter. The hose section has a first end, a body, a second end forming an opening that has a female threaded component thereon, and a first component, wherein the female threaded component is disposed at the first end, and wherein the first component is disposed at the second end which is distal from the first end, and wherein the first component comprises the male half of a quick disconnect device.

The wand comprises a first end, a body, a second end, an opening and a first component, wherein the opening is disposed at first end, and wherein first component is disposed at second end and wherein first component comprises the male half of a quick disconnect device.

The straight adapter comprises a first end, a body, a second end and a tube receiver, wherein the tube receiver is disposed at the second end, and wherein the tube receiver is adapted to interferingly receive the tube end of the vacuum cleaner connecting tube, and wherein the straight adapter further comprises the second component and a longitudinal axis, and wherein the second component is disposed at the first end, and wherein the second component comprises a spring and a thumb tab, and wherein the second component comprises the female half of a quick disconnect device. Depressing the thumb tab permits movement of the second component along the longitudinal axis, while the second component is rotationally restricted and does not rotate about the longitudinal axis, wherein any first component that is connected to a second component is released from coupling with the second component. The vacuum cleaner connecting tube is in fluid communication with the vacuum, wherein the vacuum comprises a wet or dry vacuum cleaner.

The step down adapter comprises a first end, a body, a second end, a first stepped receiver, a second stepped receiver and a third stepped receiver, wherein the first, second and third receivers are disposed at the second end and wherein the first, second and third receiver are adapted to receive in interference fit varying sizes of tube ends of vacuum cleaner connecting tubes, and wherein the step down adapter further comprises a second component and a longitudinal axis, and wherein the second component is disposed at the first end and wherein the second component comprises a spring and a thumb tab, and wherein the second component comprises the female half of a quick disconnect device. Depressing the thumb tab permits movement of the second component along the longitudinal axis, while the second component is rotationally restricted and does not rotate about the longitudinal axis wherein any first component that is connected to a second component is released from coupling with the second component.

The handled adapter comprises a first end, a body, a second end and a tube receiver, wherein the tube receiver is disposed at the second end, and wherein the tube receiver is adapted to interferingly receive the tube end of a vacuum cleaner connecting tube, and wherein the handled adapter further comprises a second component, a spring and a thumb tab, and wherein the second component is disposed at the first end and wherein the second component comprises the female half of a quick disconnect device. Depressing the thumb tab permits movement of the second component along a longitudinal axis, while the second component is rotationally restricted and does not rotate about the longitudinal axis, wherein any first component that is connected to a second component is released from coupling with the second component. The body comprises a handle, wherein the handle comprises a vertical portion and a horizontal arm.

In use, a garden hose (not shown) is connected to the drain of a water heater and the water heater is drained of substantially all the water therein. Subsequently, the garden hose is removed and the hose section is connected to the drain via the female threaded connector.

The first component of the hose section is connected to the straight adapter via the second component. Alternatively, instead of the straight adapter, the step down adapter or the handled adapter could be utilized. The first component is coupled, selectively, to the second components, respectively, of the straight adapter, the step down adapter or the handled adapter, and the tube end of the vacuum cleaner connecting tube is connected to the selected straight adapter, step down adapter or handled adapter, at the second ends, respectively, via the tube receiver of the straight adapter, the second stepped receiver of the step down adapter, the first stepped receiver of the step down adapter, the third stepped receiver of the step down adapter or the tube receiver of handled adapter, as the case may be. Vacuum is turned on and residual water and/or loose scale is removed via the drain to the vacuum.

The wand is connected, selectively, to the straight adapter, the step down adapter or the handled adapter, wherein the wand is subsequently inserted through the element opening (after removal of the heating element that is normally disposed therein). The vacuum is turned on and the wand is then manipulated to remove the remaining water and scale disposed on the bottom of the water heater.

When the handled adapter is utilized, the hand is disposed around the body and the back of the hand is disposed in contact with the horizontal arm of the handle. Further, the thumb is disposed alongside and against the thumb tab, wherein operation in concert of the thumb against the thumb tab and of the back of the hand against the horizontal arm provides leverage for rotation of the handled adapter about the longitudinal axis, thereby facilitating rotational movement of the wand to position the opening from side to side to allow the opening into corners of the water heater.

The straight adapter is utilized when no additional leverage is required and when a standard sized tube end is available (typically a two inch tube). The step down adapter is utilized when a non-standard (other than two inch diameter) tube end is only available.

Accordingly, a feature and advantage of the present invention is its ability to allow rapid interchange of components for vacuum extraction of water and/or debris.

Another feature and advantage of the present invention is its ability to allow ease of interchange of wet components.

Still another feature and advantage of the present invention is its ability to utilize a standard wet or dry vacuum apparatus.

Yet another feature and advantage of the present invention is its ability to facilitate rotation movement to allow extraction of water and/or debris from the corners of water heater tank.

Yet still another feature and advantage of the present invention is its ability to adapt to standard or non-standard-sized tube ends of a wet or dry vacuum.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred Embodiment with reference to the accompanying drawing figures, in which like reference numerals denote similar structure and refer to like elements throughout, and in which.

DETAILED DESCRIPTION OF THE PREFERRED EMBODIMENT OF THE INVENTION

Figure 1:
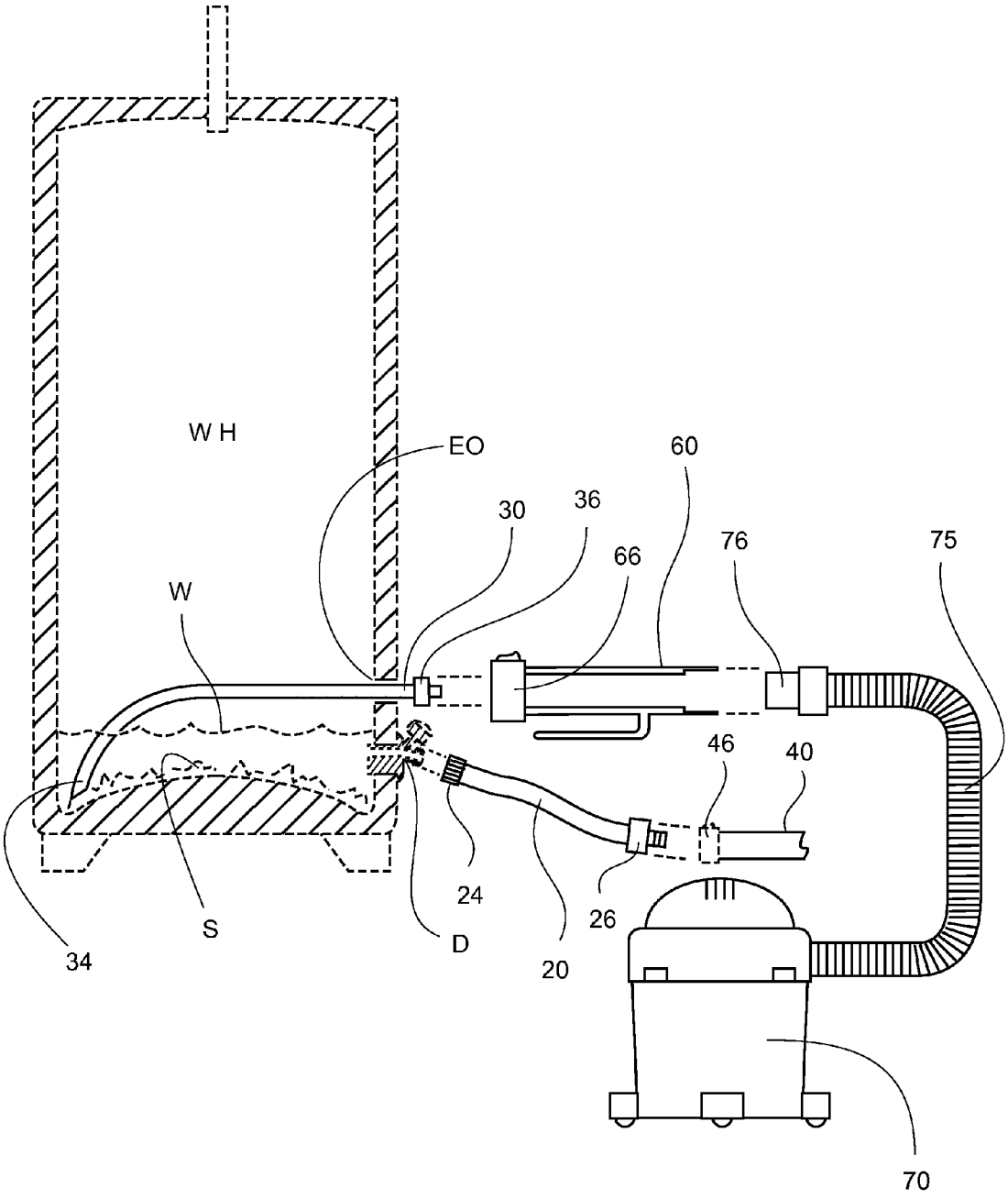
FIG. 1 is a perspective view of wand and hose section components according to a preferred embodiment of a water heater tank cleaning apparatus, shown with the wand and hose section as they enter or connect to a water tank.

In describing the preferred embodiment of the present invention, as illustrated in FIGS. 1-7, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1-7, the present invention in a preferred embodiment is water heater cleaning kit 10 (best shown in FIG. 7), wherein water heater cleaning kit 10 preferably comprises hose section 20, wand 30, straight adapter 40, step down adapter 50 and handled adapter 60.

Figure 2:
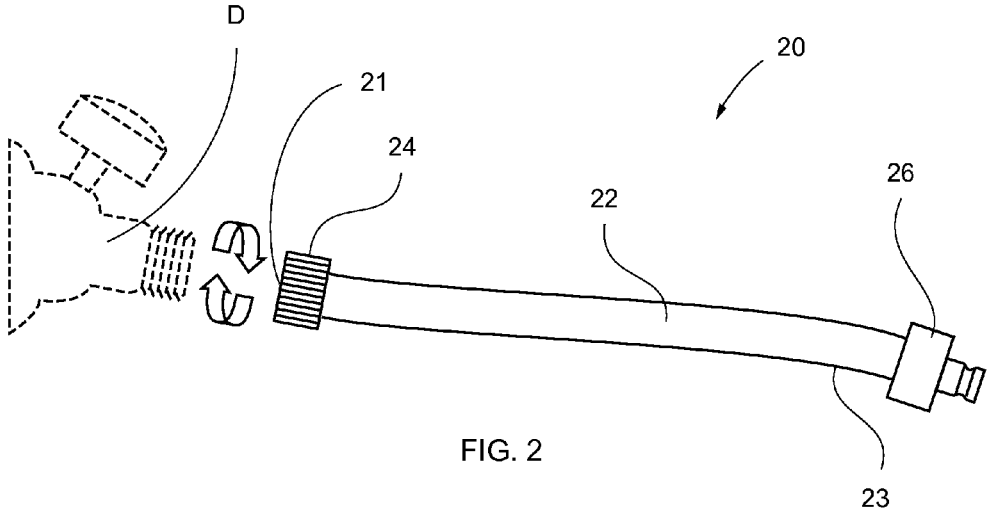
FIG. 2 is a side view of a hose section attachment according to a preferred embodiment of a water heater tank cleaning apparatus.

Referring now more particularly to FIG. 2, hose section 20 preferably comprises first end 21, body 22, second end 23, female threaded component 24 and first component 26, wherein female threaded component 24 is preferably disposed at first end 21, and wherein first component 26 is preferably disposed at second end 23 and wherein first component 26 comprises one-half, preferably the male portion, of a quick disconnect device as is known in the art.

Figure 3:
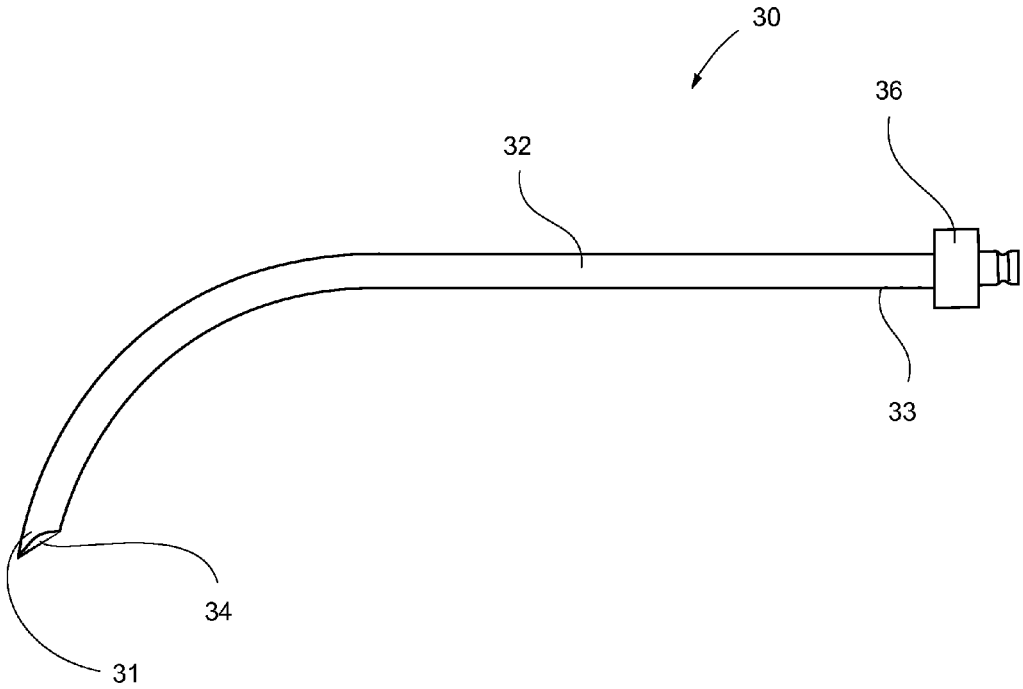
FIG. 3 is a side view of a wand attachment according to a preferred embodiment of a water heater tank cleaning apparatus.

Referring now more particularly to FIG. 3, wand 30 preferably comprises first end 31, body 32, second end 33, opening 34 and first component 36, wherein opening 34 is preferably disposed at first end 31, and wherein first component 36 is preferably disposed at second end 33 and wherein first component 36 comprises one-half, preferably the male portion, of a quick disconnect device as is known in the art. Body 32 comprises a bendable tube, wherein body 32 retains its shape once it is bent.

Figure 4:
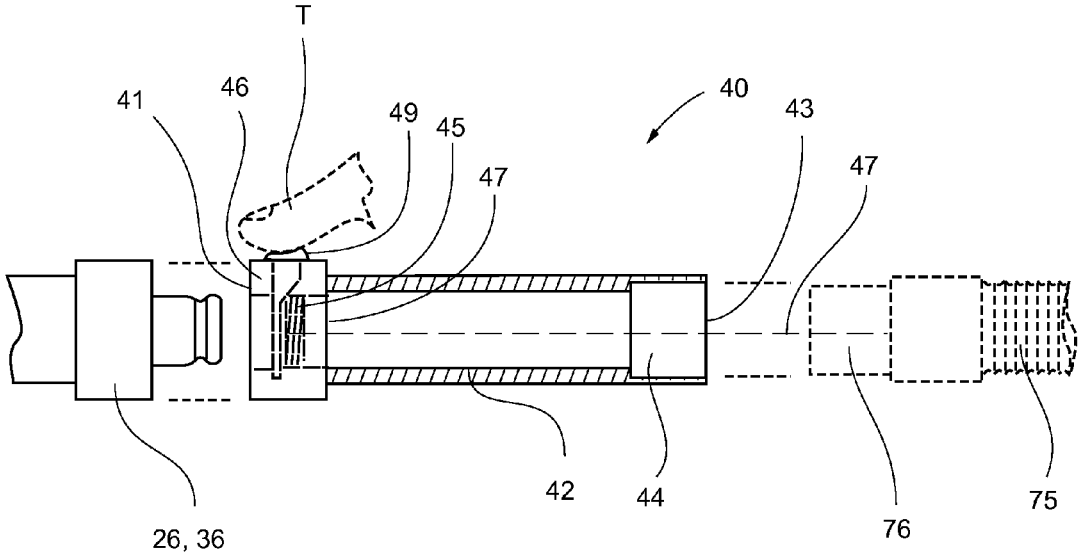
FIG. 4 is a side view of an adapter according to a preferred embodiment for connection of the hose section and wand attachments of FIGS. 2 and 3 to a vacuum cleaner of a water heater tank cleaning apparatus.

Referring now more particularly to FIG. 4, straight adapter 40 preferably comprises first end 41, body 42, second end 43 and tube receiver 44, wherein tube receiver 44 is preferably disposed at second end 43, and wherein tube receiver 44 is preferably adapted to interferingly receive tube end 76 of vacuum cleaner inlet tube 75, and wherein straight adapter 40 further preferably comprises second component 46 and longitudinal axis 47, and wherein second component 46 is preferably disposed at first end 41, and wherein second component 46 preferably comprises spring 45 and thumb tab 49, and wherein second component 46 comprises one-half, preferably the female portion, of a quick disconnect device as is known in the art. Thumb tab 49 extends radially away from said longitudinal axis 47. Depressing thumb tab 49 preferably permits movement of second component 46 along longitudinal axis 47, while second component 46 is preferably rotationally restricted and does not rotate about longitudinal axis 47, wherein any first component 26, 36 that is connected to second component 46 is preferably released from coupling with second component 46. Vacuum cleaner inlet tube 75 is preferably in fluid communication with vacuum 70, wherein vacuum 70 preferably comprises a wet or dry vacuum cleaner.

Figure 5:
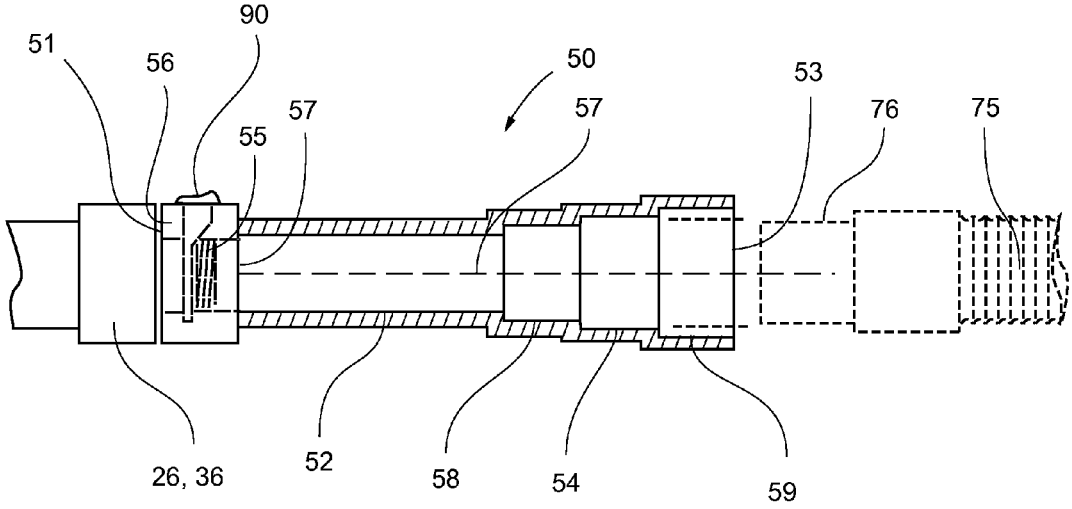
FIG. 5 is a side view of an adapter according to a preferred embodiment for connection of the hose section and wand attachments of FIGS. 2 and 3 to different sized hoses coming from a vacuum cleaner of a water heater tank cleaning apparatus.

Referring now more particularly to FIG. 5, step down adapter 50 preferably comprises first end 51, body 52, second end 53, first stepped receiver 58, second stepped receiver 54 and third stepped receiver 59, wherein first, second and third receivers 58, 54, 59 are preferably disposed at second end 53 and wherein first, second and third receiver 58, 54, 59 are preferably adapted to receive in interference fit varying sizes of tube end 76 of vacuum cleaner inlet tube 75, and wherein step down adapter 50 further preferably comprises second component 56 and longitudinal axis 57, and wherein second component 56 is preferably disposed at first end 51 and wherein second component 56 preferably comprises spring 55 and thumb tab 90, and wherein second component 56 comprises one-half, preferably the female portion, of a quick disconnect device as is known in the art. Thumb tab 90 extends radially away from said longitudinal axis 57. Depressing thumb tab 90 preferably permits movement of second component 56 along longitudinal axis 57, while second component 56 is preferably rotationally restricted and does not rotate about longitudinal axis 57 wherein any first component 26, 36 that is connected to second component 56 is preferably released from coupling with second component 56.

Figure 6:
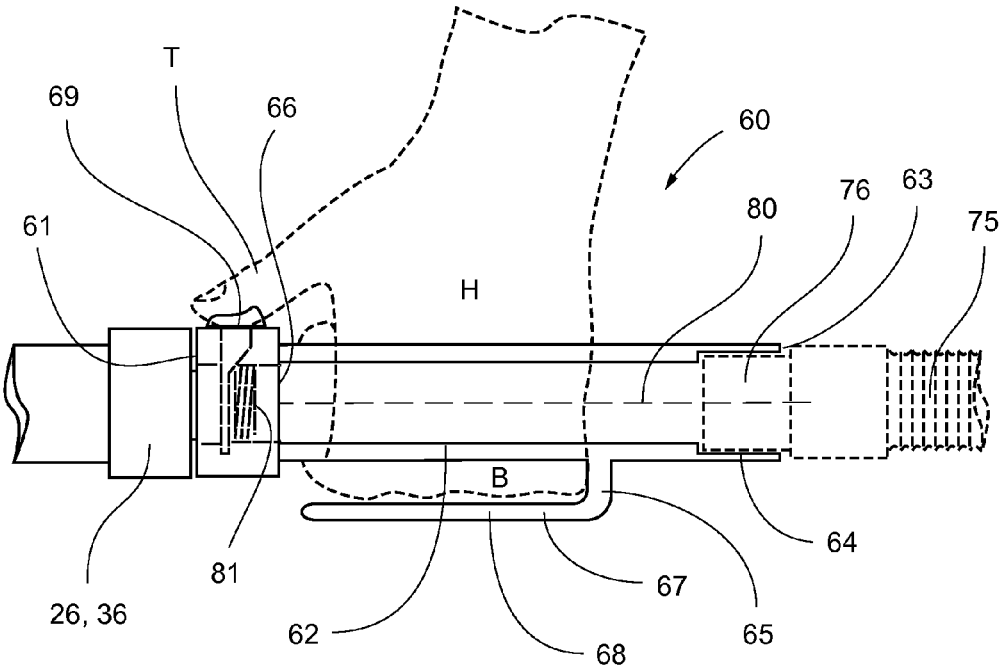
FIG. 6 is a side view of an adapter according to a preferred embodiment for connection of the wand attachment of FIG. 3 with a handle for ease and manipulation of the wand once secured of a water heater tank cleaning apparatus.
Figure 7:
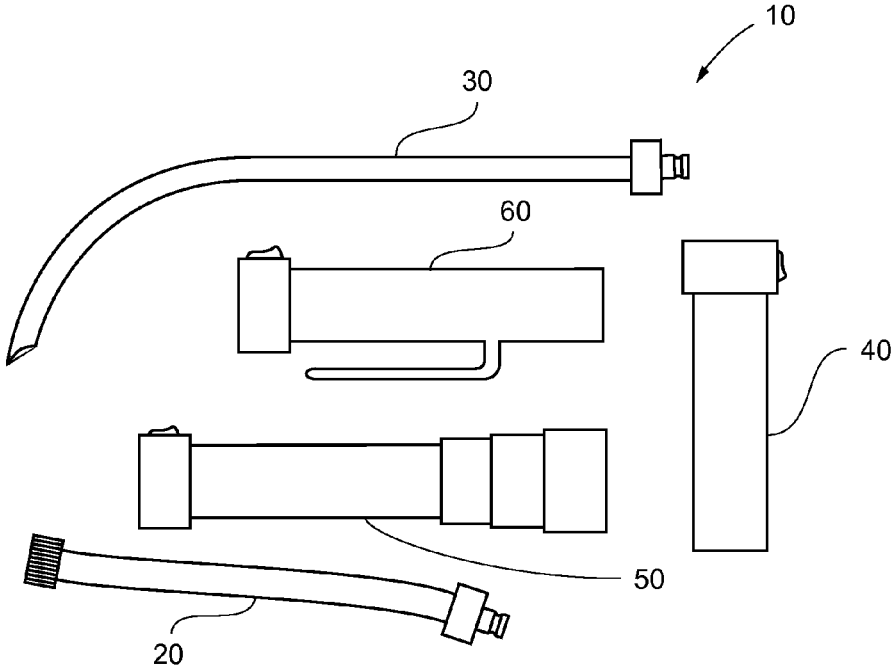
FIG. 7 is a plan view of a kit of components for a preferred embodiment of a water heater tank cleaning apparatus.

Turning now more particularly to FIG. 6, handled adapter 60 preferably comprises first end 61, body 62, second end 63 and tube receiver 64, wherein tube receiver 64 is preferably disposed at second end 63, and wherein tube receiver 64 is preferably adapted to interferingly receive tube end 76 of vacuum cleaner inlet tube 75, and wherein handled adapter 60 further preferably comprises second component 66, longitudinal axis 80, spring 81 and thumb tab 69, and wherein second component 66 is preferably disposed at first end 61 and wherein second component 66 comprises one-half, preferably the female portion, of a quick disconnect device as is known in the art. Thumb tab 69 extends radially away from said longitudinal axis 80. Depressing thumb tab 69 preferably permits movement of second component 66 along longitudinal axis 80, while second component 66 is preferably rotationally restricted and does not rotate about longitudinal axis 80, wherein any first component 26, 36 that is connected to second component 66 is preferably released from coupling with second component 66. Body 62 is disposed between ends 61, 63 and comprises handle 67, wherein handle 67 preferably comprises vertical leg 65 and horizontal arm 68, and wherein vertical leg 65 extends at approximately a ninety degree angle to body 62 and wherein horizontal arm 68 is disposed parallel to and spaced away from body 62 by vertical leg 65.

It will be recognized by those skilled in the art that one each of first components 26, 36 is secured to one each of second components 46, 56, 66 to form a quick disconnect device.

Returning now to FIG. 1, in use, a garden hose (not shown) is preferably connected to drain D and water heater WH is preferably drained of substantially all water W therein. Subsequently, the garden hose is preferably removed and hose section 20 is connected to drain D via female threaded connector 24.

First component 26 of hose section 20 is preferably connected to straight adapter 40 via second component 46. Alternatively, instead of straight adapter 40, step down adapter 50 or handled adapter 60 could be utilized. First component 26 is preferably coupled, selectively, to second component 46, 56, or 66, respectively of straight adapter 40, step down adapter 50 or handled adapter 60, and tube end 76 of vacuum cleaner inlet tube 75 is preferably connected to selected straight adapter 40, step down adapter 50 or handled adapter 60, at second ends 43, 53, 63, respectively, via tube receiver 44 of straight adapter 40, second stepped receiver 54 of step down adapter 50, first stepped receiver 58 of step down adapter 50, third stepped receiver 59 of step down adapter 50 or tube receiver 64 of handled adapter, as the case may be. Vacuum 70 is preferably turned on and residual water W and/or loose scale S is preferably removed via drain D to vacuum 70.

Wand 30 is preferably connected, selectively, to straight adapter 40, step down adapter 50 or handled adapter 60, wherein wand 30 is preferably subsequently inserted through element opening EO (after removal of the heating element that is normally disposed therein). Vacuum 70 is preferably turned on and wand 30 is then preferably manipulated to remove remaining debris, such as water W and scale S, disposed on bottom of water heater WH.

Turning now more particularly to FIGS. 1 and 6, when handled adapter 60 is utilized, hand H is preferably disposed around body 62 and back B of hand H is preferably disposed in contact with horizontal arm 68 of handle 67. Further, thumb T is preferably disposed alongside and against thumb tab 69, wherein operation in concert of thumb T against thumb tab 69 and of back B against horizontal arm 68 preferably provides leverage for rotation of handled adapter 60 about longitudinal axis 80, thereby facilitating rotational movement of wand 30 to position opening 34 from side to side to allow opening 34 into corners of water heater WH.

Straight adapter 40 is preferably utilized when no additional leverage is required and when a standard sized tube end 76 is available (typically a two inch tube). Step down adapter 50 is preferably utilized when a non-standard (other than two inch diameter) tube end 76 is only available.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A water tank cleaning apparatus comprising:

a working tip element comprising a first terminus having an opening and a second terminus having a first component of a two-component separable connector;

a vacuum source;

an adapter having a first end, a second end and a longitudinal axis therebetween, said first end having a second component of a two-component separable connector, wherein said second component comprises a thumb tab disposed thereon and extending away radially therefrom said longitudinal axis, and wherein said thumb tab facilitates separation of said two-component separable connector when force applied to said thumb tab urges said second component towards said longitudinal axis, and said second end adapted to receive said vacuum source; and wherein said first and second components cooperatively engage to secure said first and second components together and to permit fluid communication between said working tip element, said adapter, and said vacuum source.

2. The water tank cleaning apparatus of claim 1, wherein said second end comprises stepped diameter reductions, and wherein said stepped diameter reductions are adapted to interferingly receive therewithin a tube end of different diameter from said vacuum source.

3. The water tank cleaning apparatus of claim 1, wherein said first component is rotationally restricted.

4. The water tank cleaning apparatus of claim 1, wherein said second component comprises a spring, and wherein said spring urges said first component to secure said second component there together.

5. The water tank cleaning apparatus of claim 1, wherein said first component is slidably operational in a direction parallel to said longitudinal axis of said adapter.

6. The water tank cleaning apparatus of claim 1, wherein said first terminus a water outlet fitting is adapted to engage said water outlet fitting on the water tank.

7. The water tank cleaning apparatus of claim 6, wherein said second terminus comprises a threaded female fitting.

8. The water tank cleaning apparatus of claim 1, wherein said working tip element comprises a bendable tube.

9. The water tank cleaning apparatus of claim 8, wherein said bendable tube retains its shape once it is bent.

10. The water tank cleaning apparatus of claim 1, wherein said adapter comprises a handle.

11. The water tank cleaning apparatus of claim 10, wherein said adapter comprises a body section disposed between said first end and said second end, and wherein said handle comprises a vertical leg and a horizontal arm, and wherein said vertical leg extends at approximately a ninety degree angle to said body section and wherein said horizontal arm is disposed parallel to and spaced away from said body section by said vertical leg.

12. The water tank cleaning apparatus of claim 11, wherein said handle provides fixed anchor against which a back portion of an operator's hand rests when the hand grips said body section, and wherein leverage to rotate said water tank cleaning apparatus is provided via in cooperation between a thumb of the operator's hand, and wherein said thumb rests against said thumb tab.

13. The water tank cleaning apparatus of claim 1, wherein said second end is adapted to interferingly receive a tube end of a vacuum tube from said vacuum source.

* * * * *